United States Patent [19]

Ferguson et al.

[11] Patent Number: 4,510,788

[45] Date of Patent: Apr. 16, 1985

[54] METHOD OF FORGING A WORKPIECE

[75] Inventors: Blake L. Ferguson, Broadview Heights; Donald J. Moracz, Garfield Heights, both of Ohio

[73] Assignee: TRW Inc., Cleveland, Ohio

[21] Appl. No.: 506,305

[22] Filed: Jun. 21, 1983

[51] Int. Cl.[3] ..... B21D 53/28; B21D 31/00

[52] U.S. Cl. ..... 72/377; 29/159.2; 72/344; 72/354; 72/360

[58] Field of Search ..... 72/344, 352, 353, 354, 72/359, 360, 366, 377; 29/159.2

[56] References Cited

FOREIGN PATENT DOCUMENTS 2848091 5/1980 Fed. Rep. of Germany ..... 29/159.2

45-16810 10/1970 Japan ..... 29/159.2

*Primary Examiner*—W. D. Bray

*Attorney, Agent, or Firm*—Yount & Tarolli

[57] ABSTRACT

A metal workpiece, such as a gear blank, is forged in a press. The workpiece is first heated and then placed in a working chamber above the press. Force is applied against opposite sides of the workpiece to press the metal of the workpiece outwardly against a sidewall formed by a ring die and inwardly against a side surface of a removable center section. After the workpiece has been shaped, the workpiece and the center section are removed from the working chamber of the press with the center section firmly gripped by the workpiece. The workpiece is then allowed to cool and the center section is separated from the workpiece.

5 Claims, 6 Drawing Figures

METHOD OF FORGING A WORKPIECE

This invention was made in the performance of work under U.S. Army Contract No. DAAE07-80-C-9115.

BACKGROUND OF THE INVENTION

The present invention relates to a new and improved method of forging a metal workpiece in a press, and more particularly to a method of forging a metal workpiece having a hole which extends through the workpiece.

Workpieces having through-holes, such as gear blanks, have previously been forged in presses. In forging the workpieces, mandrels have been used to form and locate holes in the workpieces.

During warm and hot forging, a workpiece is chilled by the die due to temperature differences between the workpiece and the mandrel. As this chilling occurs, the workpiece shrinks, due to thermal contraction. This locks the workpiece onto the mandrel at the through-hole location. When the workpiece is stripped from the forging mandrel, relatively high ejection loads are encountered. For presses with weak ejection systems, the pressure needed to overcome the workpiece stripping load may exceed the capacity of the press.

BRIEF DESCRIPTION OF THE INVENTION

The present invention provides a new and improved method of forging a workpiece having a through-hole without encountering excessive ejection loads in stripping the forged workpiece from a mandrel or hole forming member. In practicing the invention, the workpiece is heated and then placed in the working chamber of a press. Force is applied against opposite sides of the workpiece to force the metal of the workpiece outwardly against the sidewall of the working chamber and inwardly against an outer side surface of a removable center section. The workpiece and center section are then removed from the working chamber with the workpiece gripping the center section. The workpiece is then cooled and the center section is removed from the workpiece with relatively little force.

Accordingly, it is an object of this invention to provide a new and improved method of forming a workpiece having a through-hole and wherein the workpiece and hole-forming member are separated after they have been removed from the working chamber of a press. The invention allows a net-shaped bore configuration to be produced during forging.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
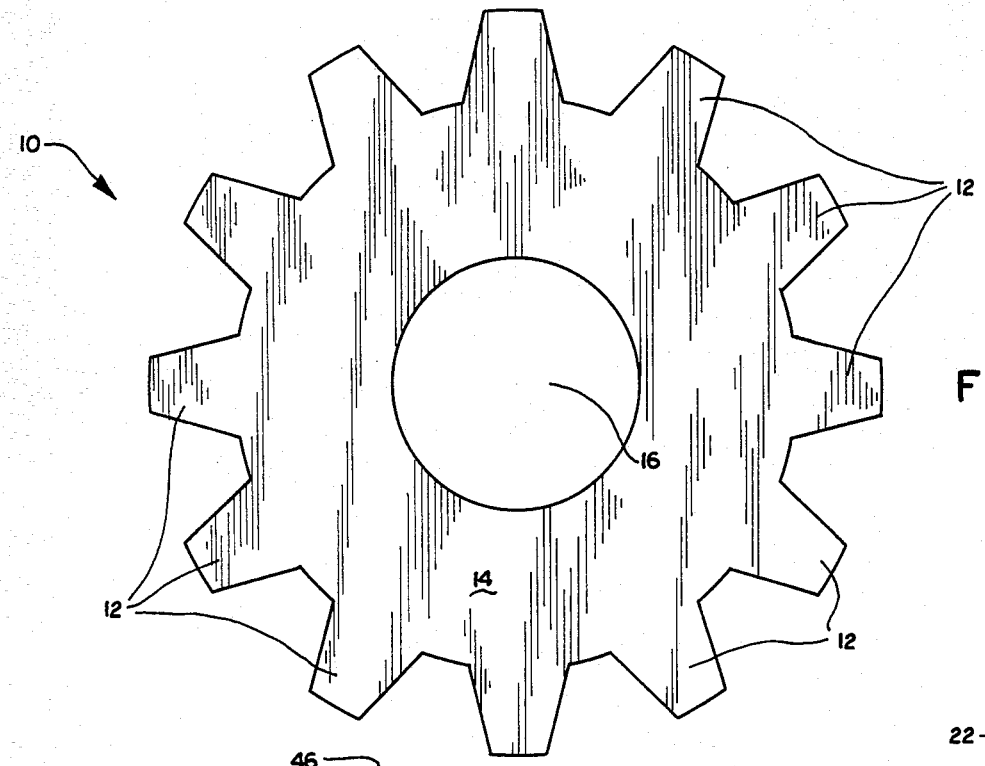
FIG. 1 is a schematic illustration of a forged gear having a hole through a central portion of the gear.

A gear 10 which was forged by the method of the present invention is schematically illustrated in FIG. 1. The gear 10 includes a plurality of teeth 12 which are disposed in a circular array about a hub 14. A circular hole 16 extends through the hub 14 to enable the gear 10 to be mounted on a cylindrical shaft. Although the hole 16 has been illustrated as having a cylindrical configuration, it is contemplated that a keyway could be formed in the hole to facilitate holding the gear against rotation relative to a shaft. Although the present invention is described herein in connection with the forming of a gear, it is contemplated that the invention could be used in connection with the forging of many different types of articles having through-holes.

Figure 2:
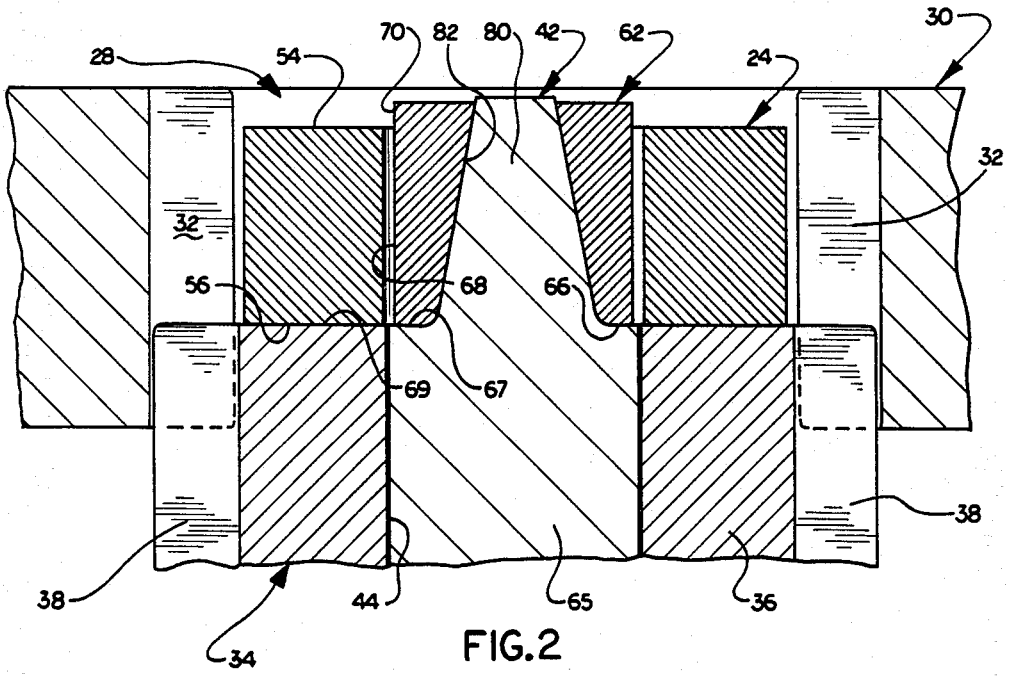
FIG. 2 is a fragmentary schematic illustration depicting the relationship between a workpiece and a working chamber of a press prior to forging of the workpiece to form the gear of FIG. 1.

A press 22 for forging a workpiece or gear blank 24 to form the gear 10 is illustrated in FIG. 2. The press 22 includes a working chamber 28 in which the annular workpiece 24 is placed. Before the workpiece 24 is placed in the annular working chamber 28, the workpiece is heated to a temperature of approximately 2,100° F. for hot forging operations or approximately 1,000° F. for warm forging operations. The workpiece is formed of metal, such as a forgeable steel or a sintered powder preform.

A circular ring die 30 forms the sidewall of the working chamber 28. The ring die 30 has a circular array of radially inwardly projecting teeth 32. The teeth 32 on the ring die 30 have a configuration corresponding to the configuration of the spaces between the teeth 12 formed in the gear 10.

A lower punch 34 cooperates with the ring die 30 to form the bottom of a working chamber 28. The lower punch 34 has an annular central portion 36 with external or radially outwardly projecting teeth 38 having the same configuration as the teeth 12 on the gear 10. The external teeth 38 on the lower punch 34 mesh with the internal teeth 32 on the ring die 30.

A generally cylindrical core 42 extends into the working chamber 28 in a coaxial relationship with the ring die 30 and lower punch 34. The central core 42 has an outside diameter which is the same as the inside diameter of the hole 16 in the gear 10 (see FIG. 1). The core 42 extends through a cylindrical opening 44 in the lower punch 34.

An upper punch 46 cooperates with the lower punch 34 to apply force to opposite sides of the heated workpiece 24. Thus, the upper punch 46 has an annular central portion 38 of the same size as the central portion 36 of the lower punch 34. A cylindrical opening 49 in the upper punch 46 is sized to receive the core 42. A plurality of teeth 50 extend radially outwardly from the central portion 38 of the upper punch 46 and have the same configuration as the teeth 12 of the gear 10 (see FIG. 1). The external teeth 50 on the upper punch 46 can mesh with the internal teeth 32 on the ring die 30 in the same manner as the external teeth 38 on the lower punch 34.

The heated workpiece 24 is forged to the configuration of the gear 10 by applying force against an annular upper side surface 54 (FIG. 2) of the workpiece 24 with the upper punch 46 and against an annular lower side surface 56 of the workpiece with the lower punch 34. Thus, the upper punch 46 is moved downwardly into the working chamber 28 to compress the workpiece 24 in the manner shown in FIG. 3. As the upper punch 46 is lowered, the external teeth 50 on the upper punch 46 mesh with the internal teeth 32 on the ring die 30 to seal the upper end of the working chamber 46.

Continued downward movement of the upper punch 46 compresses the workpiece 24 between the upper and lower punches 34 and 46. As the heated workpiece 24 is compressed, the metal of the workpiece flows radially outwardly between the internal teeth 32 on the ring die 30. In addition, the metal of the workpiece 24 is compressed radially inwardly against the central core 42. This results in the forging of the workpiece 24 to the same configuration as the gear 10 of FIG. 1. The manner in which the lower and upper punches 34 and 46 cooperate to forge the workpiece 24 to form the gear 10 is well known and is generally similar to that disclosed in U.S. Pat. No. 3,398,444.

Figure 3:
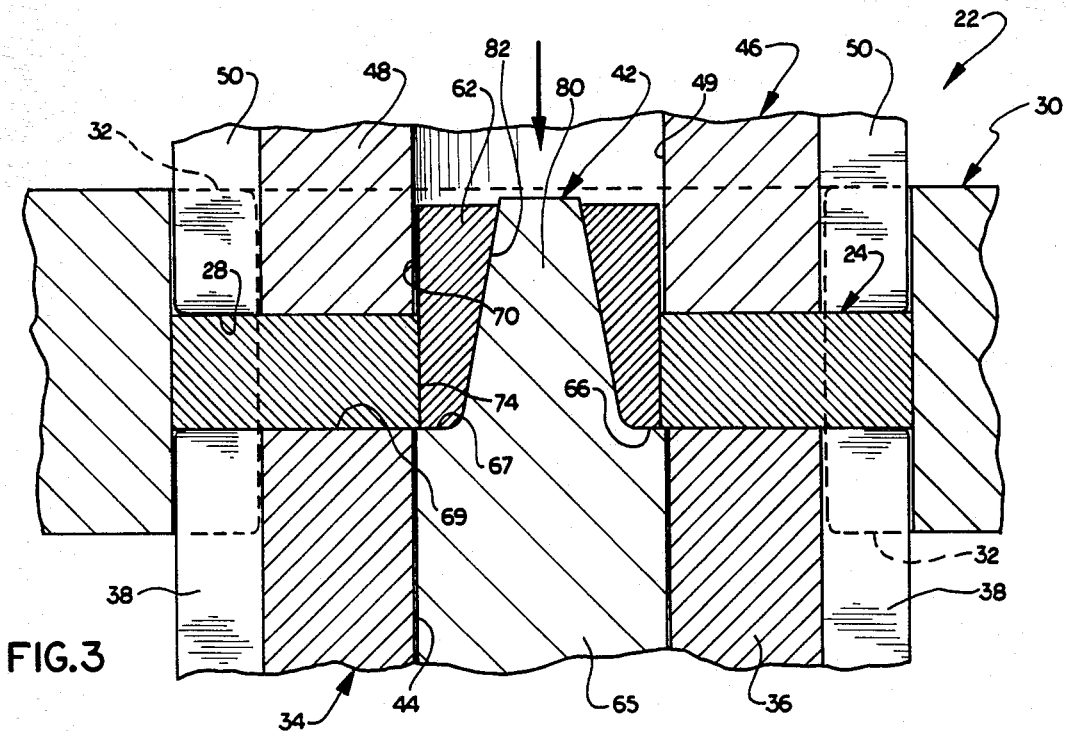
FIG. 3 is a schematic fragmentary illustration, generally similar to FIG. 2, illustrating the manner in which force is applied to opposite sides of the workpiece by a pair of punches.
Figure 4:
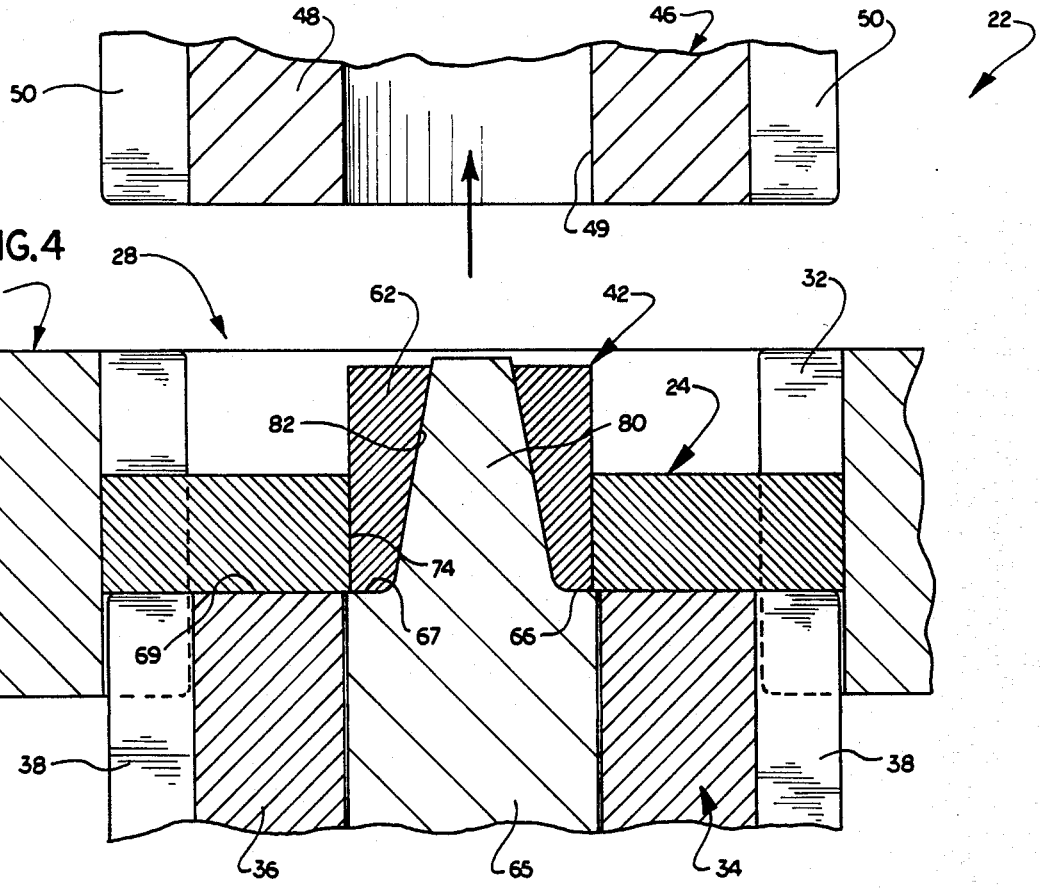
FIG. 4 is a fragmentary schematic illustration, generally similar to FIGS. 2 and 3, illustrating the forged workpiece and press after one of the punches has been withdrawn.

Once the workpiece 24 has been forged to the configuration of the gear 10, the upper punch 46 is raised clear of the ring die, in the manner shown in FIG. 4. After the upper punch 46 has been raised, the forged workpiece 24 is ejected from the working chamber 28. This is accomplished by raising the lower punch from the retracted position shown in FIGS. 3 and 4 to the extended position shown in FIG. 5. As the punch 34 is raised, it is moved through a distance which is substantially the same as the original axial extent of the working chamber 28. This moves the forged workpiece clear of the internal teeth 32 on the ring die 30.

In accordance with a feature of the present invention, the central core 42 includes a removable center section 62 which is ejected from the working chamber 28 along with the forged workpiece 24. Therefore, when the lower punch 34 is raised to eject the forged workpiece from the working chamber, the punch must apply a stripping force against the workpiece sufficient to overcome only the gripping action between the forged workpiece and the internal teeth 32 on the ring die 30. If the center section 62 was removed from the workpiece 24 as it was ejected from the working chamber, substantially greater stripping forces would be required.

Prior to forging of the workpiece 24, the hollow center section 62 is telescoped over a stationary support rod 65 (see FIG. 2). The center section 62 has an axial extent which is slightly less than the axial extent of the working chamber 28 and is greater than the axial extent of the workpiece 24. The center section 62 has an annular end surface 66 which engages an annular shoulder 67 on the support rod 65. The shoulder 67 is disposed in a coplanar relationship with an annular bottom surface 69 of the working chamber 28. If desired, the shoulder 67 could be disposed below the surface 69 to form an axially projecting shoulder on the workpiece 24.

The annular workpiece 24 initially has an opening 68 (FIG. 2) of a diameter which is greater than the diameter of a cylindrical outer side surface 70 of the center section 62. Therefore the lower surface 56 of the workpiece 28 rests on the bottom surface 69 of the working chamber 28 at the same level as the end surface 66 of the center section 62.

As the heated workpiece 24 is forged from the initial configuration of FIG. 2 to the final configuration of FIG. 3, the metal of the workpiece is pressed firmly against the cylindrical outer side surface 70 of the removable center section 62. This results in a firm gripping action between the inner side surface 74 of a hole 16 in the forged workpiece 24 and the outer side surface 70 of the removable center section 62. When the center section 62 is ejected from the working chamber 28 (FIG. 5), the workpiece 24 has a relatively firm grip on the center section 62. At that time, a substantial force would be required to slide the workpiece off of the center section 62.

As the workpiece 24 is ejected from the working chamber 28 with the center section 62 in the opening in the center of the workpiece (see FIGS. 5 and 6), the workpiece 24 elastically expands radially outwardly. This elastic expansion is due to the releasing of the workpiece from the ring die 30. The elastic expansion of the workpiece 24 results in a reduction in the force with which the workpiece grips the center section 62.

After the workpiece 24 has been ejected from the chamber 28 and has cooled, the center section 62 can be readily disengaged from the workpiece. Thus, the center section 62 can be forced axially outwardly, that is upwardly as viewed in FIG. 6, out of engagement with the workpiece 24 once the workpiece has cleared the ring gear 30.

Once the center section 62 has been removed from the workpiece 24, the center section can be placed back over the support rod 66 and used in the forming of a subsequent workpiece. Thus, the support rod 66 has an upwardly projecting mounting section 80 which has a frustoconical configuration. The mounting section 80 is telescopicallv received in a frustoconical central opening 82 formed in the center section 62. The mounting section 80 then engages the center section 62 to position it in the working chamber 28 during the forming of a second workpiece.

Since the center section 62 is removable, a center section of a different size can be used in place of the center section 62 when a larger or smaller hole is to be formed in the workpiece 24. Thus, if a larger hole is to be formed in the workpiece 24, a center section having a larger outside diameter is used in place of the illustrated center section 62. Of course, the center section with the larger outside diameter would have a frustoconical internal opening of the same size and shape as the opening 82 in the center section 62.

If desired, the center section 62 can be replaced with a center section having an axially extending slot in its outer side surface so that a radially inwardly projecting key is formed in the opening 74 in the workpiece 24. This key would engage a correspondingly shaped slot in a shaft upon which the workpiece is to be mounted. Similarly, the outer side surface of the center section 62 could be formed with a plurality of straight, axially extending slots or grooves to form axially extending and radially inwardly projecting splines or teeth in the hole 16 of the workpiece 24. Since the center section 62 is removed each time a workpiece is ejected from the press 10, the center section 62 can be readily replaced if it becomes worn.

Figure 5:
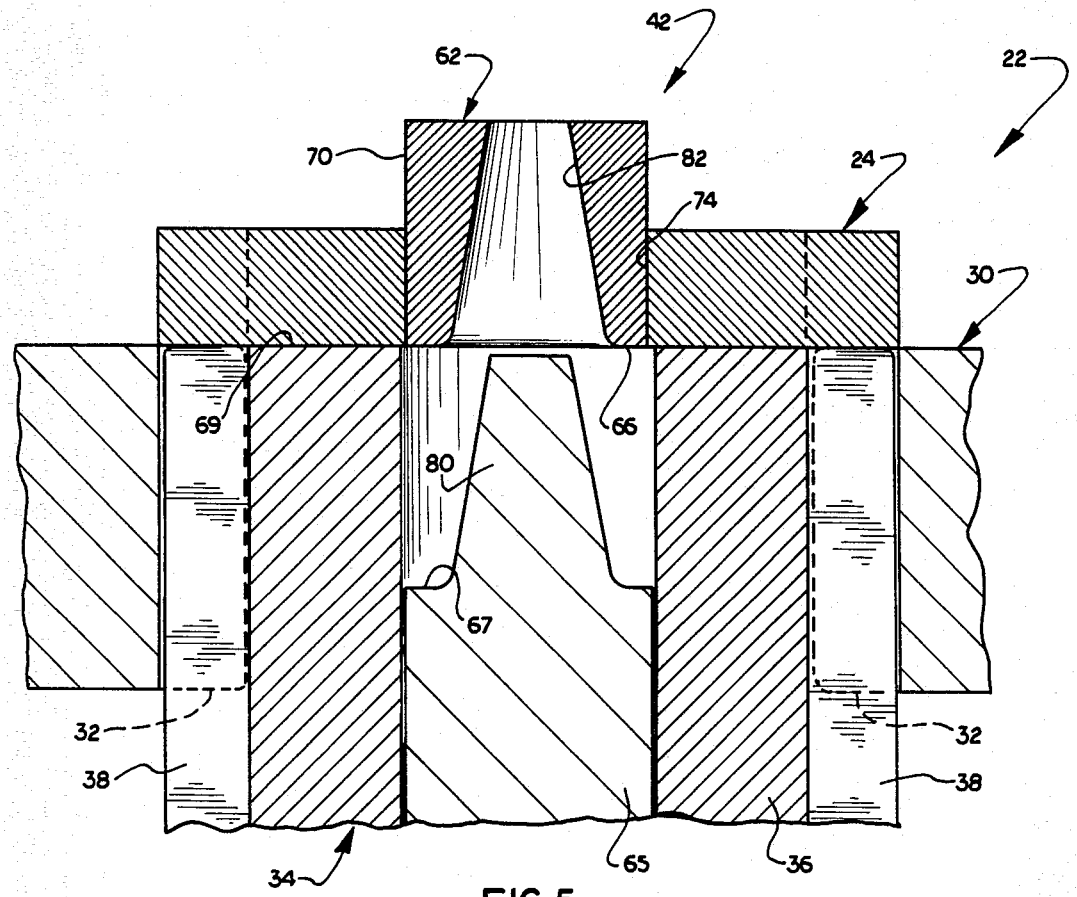
FIG. 5 is a fragmentary schematic illustration depicting the manner in which the workpiece and a removable center section are ejected from a working chamber of the press.
Figure 6:
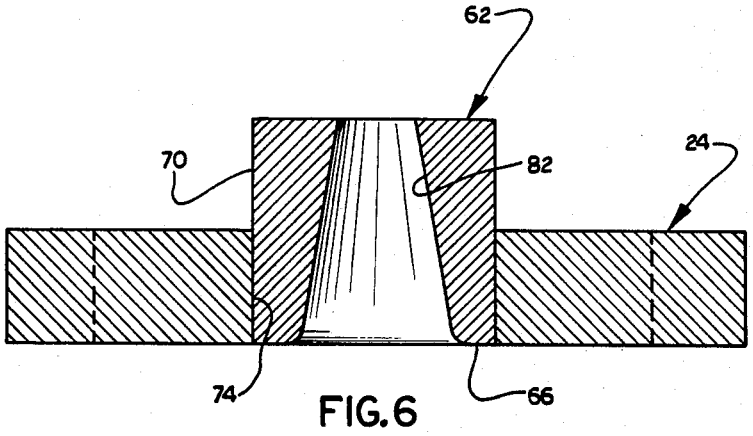
FIG. 6 is a sectional view illustrating the relationship between the workpiece and the removable center section before the center section is separated from the workpiece.

The present invention provides a new and improved method of forging a workpiece 24 having a through-hole without encountering excessive ejection loads in stripping the forged workpiece from a mandrel or hole forming member. In practicing the invention, the workpiece is heated and then placed in the working chamber 28 of a press 22. Force is applied against opposite sides of the workpiece 24 (FIG. 3) to force the metal of the workpiece outwardly against the ring die 30 which forms the sidewall of the working chamber 28 and inwardly against an outer side surface 70 of a removable center section 62. The workpiece 24 and center section 62 are then removed from the working chamber 28 with the workpiece gripping the center section (FIG. 5). After the workpiece 24 has cooled, the center section 62 is removed from the workpiece with relatively little force.

Having described specific preferred embodiments of the invention, the following is claimed:

1. A method of forging a metal workpiece in a press having a working chamber partially defined by a side wall which extends around a removable center section which is hollow, said method comprising the steps of placing the workpiece in the chamber, telescoping the center section over a support member, thereafter, applying force against opposite sides of the workpiece to press the metal of the workpiece against the side wall of the chamber and against the outer side surface of the center section, supporting the center section with the support member during the application of force against opposite sides of the workpiece, removing the workpiece and center section from the chamber with the workpiece gripping the center section, and, thereafter, separating the center section from the workpiece.

2. A method as set forth in claim 1 further including the steps of placing the center section in the working chamber after having removed the center section from the workpiece, placing a second metal workpiece in the chamber, and applying force against opposite sides of the second workpiece to press the metal of the second workpiece against the sidewall of the chamber and against the outer side surface of the center section.

3. A method as set forth in claim 1 further including the steps of heating the workpiece prior to performance of said step of placing the workpiece in the chamber, heating the center section with heat transferred from the workpiece prior to removal of the workpiece and center section from the working chamber, and cooling the center section and the workpiece after performing said step of removing the workpiece and center section from the chamber and prior to separating the center section from the workpiece.

4. A method as set forth in claim 1 wherein a plurality of axially extending slots are formed in the outer surface of the center section, said step of applying force against opposite sides of the workpiece to press the workpiece against outer side surface of the center section includes forming internal splines in the workpiece.

5. A method as set forth in claim 1 wherein an axially extending slot is formed in the outer surface of the center section, said step of applying force against opposite sides of the workpiece to press the workpiece against the outer side surface of the center section includes forming an inwardly extending projection in the workpiece.

* * * * *